US008056709B2

(12) United States Patent
Sutherland

(10) Patent No.: US 8,056,709 B2
(45) Date of Patent: Nov. 15, 2011

(54) PACKAGES FOR CONTAINERS

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 886 days.

(21) Appl. No.: 11/624,005

(22) Filed: Jan. 17, 2007

(65) Prior Publication Data

US 2007/0163908 A1 Jul. 19, 2007

Related U.S. Application Data

(60) Provisional application No. 60/759,319, filed on Jan. 17, 2006, provisional application No. 60/763,425, filed on Jan. 30, 2006.

(51) Int. Cl.
*B65D 75/02* (2006.01)

(52) U.S. Cl. ..... 206/148; 206/434; 206/147

(58) Field of Classification Search ..... 206/147–161, 206/193, 427, 434, 139, 140, 145; 229/198.2, 229/148

See application file for complete search history.

(56) References Cited

U.S. PATENT DOCUMENTS

| | | | | |
|---|---|---|---|---|
| 2,737,326 | A | | 3/1956 | Toensmeier |
| 2,764,284 | A | | 9/1956 | Arneson |
| 2,950,041 | A | | 8/1960 | Stone |
| 3,245,711 | A | | 4/1966 | Dantoin |
| 3,612,266 | A | | 10/1971 | Graser |
| 3,722,945 | A | | 3/1973 | Wood |
| 3,767,041 | A | | 10/1973 | Graser |
| 4,131,198 | A | | 12/1978 | Fischer |
| 4,164,286 | A | * | 8/1979 | Sutherland ..... 206/434 |
| 4,188,766 | A | | 2/1980 | Culpepper |
| 4,192,540 | A | | 3/1980 | Oliff |
| 4,326,628 | A | | 4/1982 | Wood |
| 4,336,898 | A | | 6/1982 | Joyce |
| 4,432,579 | A | | 2/1984 | Denmark et al. |
| 4,438,843 | A | | 3/1984 | Graser |
| 4,489,880 | A | * | 12/1984 | Calvert ..... 206/434 |
| 4,566,591 | A | * | 1/1986 | Turtschan et al. ..... 206/427 |
| 4,703,847 | A | | 11/1987 | Oliff |
| 5,135,104 | A | | 8/1992 | Jorba |
| 5,188,225 | A | | 2/1993 | Jorba |
| 5,323,895 | A | | 6/1994 | Sutherland et al. |
| 5,351,815 | A | | 10/1994 | Fogle et al. |
| 5,407,065 | A | | 4/1995 | Sutherland |
| 5,439,112 | A | * | 8/1995 | De Guglielmo et al. ..... 206/434 |
| 5,445,262 | A | | 8/1995 | Sutherland |

(Continued)

FOREIGN PATENT DOCUMENTS

DE 196 42 571 A1 5/1997

(Continued)

OTHER PUBLICATIONS

Decision to Grant European Patent—application No. 07718328.3—mail date Sep. 24, 2009.

(Continued)

*Primary Examiner* — J. Gregory Pickett
*Assistant Examiner* — Andrew Perreault
(74) *Attorney, Agent, or Firm* — Womble Carlyle Sandridge & Rice, LLP

(57) ABSTRACT

Packages are formed for holding containers that extend through a bottom panel of the package. Braces are provided for at least partially securing the containers in the package.

17 Claims, 16 Drawing Sheets

U.S. PATENT DOCUMENTS

| | | | | | |
|---|---|---|---|---|---|
| 5,484,059 | A | | 1/1996 | Sutherland | |
| 5,503,267 | A | | 4/1996 | Sutherland | |
| 5,588,586 | A | * | 12/1996 | Negelen | 229/198.2 |
| 5,598,920 | A | | 2/1997 | Hansen | |
| 5,620,094 | A | * | 4/1997 | Naumann | 206/434 |
| 5,638,956 | A | | 6/1997 | Sutherland | |
| 5,687,838 | A | | 11/1997 | Bakx | |
| 5,845,776 | A | | 12/1998 | Galbierz et al. | |
| 5,921,392 | A | * | 7/1999 | Davis | 206/434 |
| 5,957,289 | A | * | 9/1999 | Negelen | 206/434 |
| 5,960,945 | A | | 10/1999 | Sutherland | |
| 5,984,086 | A | | 11/1999 | Foushee et al. | |
| 6,021,897 | A | | 2/2000 | Sutherland | |
| 6,223,892 | B1 | * | 5/2001 | Bakx | 206/148 |
| 6,315,111 | B1 | | 11/2001 | Sutherland | |
| 6,488,322 | B2 | | 12/2002 | Bakx | |
| 6,615,984 | B2 | | 9/2003 | Saulas et al. | |
| 7,083,046 | B2 | * | 8/2006 | Bakx | 206/434 |
| 7,264,114 | B2 | | 9/2007 | Daniel | |
| 2002/0113449 | A1 | | 8/2002 | Bakx | |
| 2004/0079666 | A1 | | 4/2004 | Bakx | |
| 2004/0226833 | A1 | | 11/2004 | Daniel | |
| 2007/0000794 | A1 | * | 1/2007 | Requena | 206/139 |
| 2008/0202946 | A1 | * | 8/2008 | Jego | 206/151 |

FOREIGN PATENT DOCUMENTS

| | | | | |
|---|---|---|---|---|
| DE | 203 17 334 | U1 | | 2/2004 |
| DE | 20 2004 004 248 | U1 | | 8/2004 |
| DE | 20 2004 017 954 | U1 | | 2/2005 |
| EP | 0 048 506 | | | 3/1982 |
| EP | 0 285 043 | A1 | | 10/1988 |
| EP | 0 398 835 | B1 | | 11/1990 |
| EP | 0 495 197 | A1 | | 7/1992 |
| EP | 0 541 334 | A1 | | 5/1993 |
| EP | 541334 | A1 | * | 5/1993 |
| EP | 0 780 320 | A1 | | 6/1997 |
| EP | 1 070 671 | A1 | | 1/2001 |
| EP | 1 384 679 | A1 | | 1/2004 |
| FR | 1.582.235 | | | 9/1969 |
| FR | 2 525 992 | | | 11/1983 |
| FR | 2 664 239 | | | 1/1992 |
| FR | 2 731 413 | | | 9/1996 |
| GB | 1 342 180 | | | 12/1973 |
| GB | 2 085 391 | A | | 4/1982 |
| GB | 2 158 037 | A | | 11/1985 |
| WO | WO 97/33807 | | | 9/1997 |
| WO | WO 98/49071 | | | 11/1998 |
| WO | WO 99/01356 | | | 1/1999 |
| WO | WO 02/059011 | A2 | | 8/2002 |
| WO | WO 02/062676 | A1 | | 8/2002 |
| WO | WO 02/079048 | A1 | | 10/2002 |
| WO | WO 03/016167 | A1 | | 2/2003 |
| WO | WO 2005/095222 | A1 | | 10/2005 |
| WO | WO 2006/044583 | A2 | | 4/2006 |
| WO | WO 2006/108098 | A1 | | 10/2006 |
| WO | WO 2007/044525 | A1 | | 4/2007 |

OTHER PUBLICATIONS

Notice of Acceptance for Australian Patent—application No. 2007207591—mail date Dec. 17, 2009.

Notice of Acceptance for New Zealand Patent—application No. 569902—mail date Mar. 3, 2010.

Notice of Allowance for Canadian Patent—application No. 2,637,353—mail date Jun. 15, 2010.

* cited by examiner

PACKAGES FOR CONTAINERS

CROSS-REFERENCE TO RELATED APPLICATIONS

This application claims the benefit of U.S. Provisional Application Nos. 60/759,319, which was filed on Jan. 17, 2006 and 60/763,425 which was filed on Jan. 30, 2006. The entire contents of both of the above-referenced provisional applications are hereby incorporated by reference as if presented herein in their entirety.

BACKGROUND OF THE INVENTION

The present invention generally relates to packages or cartons for holding and displaying containers. More specifically, the invention is directed to a package having one or more braces that engage the containers and at least partially restrain movement of the containers held by the package.

Packages or cartons for engaging upper portions of containers are known. The containers are typically inserted through apertures in a bottom panel of the package and secured by engaging a radially protruding part of the containers. One such package is disclosed in U.S. Pat. No. 6,223,891 to Bakx. Existing packages, however, may not sufficiently brace the containers, may be difficult to erect, and/or may occupy too much board space, which results in higher costs of construction. As such, a need exists for an improved package for holding and displaying containers.

SUMMARY OF THE INVENTION

In general, one aspect of the invention is directed to a package for holding a plurality of containers. The package comprises panels that extend at least partially around an interior of the package. The panels comprise a top panel, a bottom panel, a first side panel and a second side panel. At least one feature is in the bottom panel for receiving and holding top portions of the container. The at least one feature comprises at least two apertures for receiving the top portions of the containers and a brace disposed between the apertures to engage the containers and at least partially restrain movement of the containers in the package. The brace comprises a first brace panel foldably attached to the bottom panel and a second brace panel foldably attached to the bottom panel. The first and second brace panel are interlockingly engaged to form the brace.

In another aspect, the invention is generally directed to a blank for forming a package for holding a plurality of containers. The blank comprises panels comprising a top panel, a bottom panel, a first side panel and a second side panel. At least two apertures are in the bottom panel. A first brace panel is foldably attached to the bottom panel and a second brace panel are foldably attached to the bottom panel. The first and second brace panels are adapted for interlocking engagement with respect to one another. The first and second brace panels are respectively positioned in the apertures.

In another aspect, the invention is generally directed to a method of forming a package for containing a plurality of containers. The method comprising providing a blank having a bottom panel, a first brace panel foldably attached to the bottom panel, and a second brace panel foldably attached to the bottom panel. The method further comprising forming a brace by folding the first brace panel and the second brace panel so that the brace panels are in interlocking engagement.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to constructs, sleeves, cartons, or the like, and packages for holding and displaying articles such as containers, jars, bottles, cans, etc. The articles can be used for packaging food and beverage products, for example. The articles can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages according to the present invention can accommodate articles of numerous different shapes. For the purpose of illustration and not for the purpose of limiting the scope of the invention, the following detailed description describes food product containers (e.g., plastic containers) at least partially disposed within the package embodiments. In this specification, the terms "lower," "bottom," "upper" and "top" indicate orientations determined in relation to fully erected packages.

The present embodiments are addressed to cartons or packages for attachment to containers. A first package or carrier 140 embodiment is illustrated in its erected state in FIGS. 3-7, in which it is attached to containers C. In the illustrated embodiments the containers C are illustrated as single-serving beverage containers having a top flange portion F, but other containers may be held in the package 140 without departing from the invention.

Figure 1:
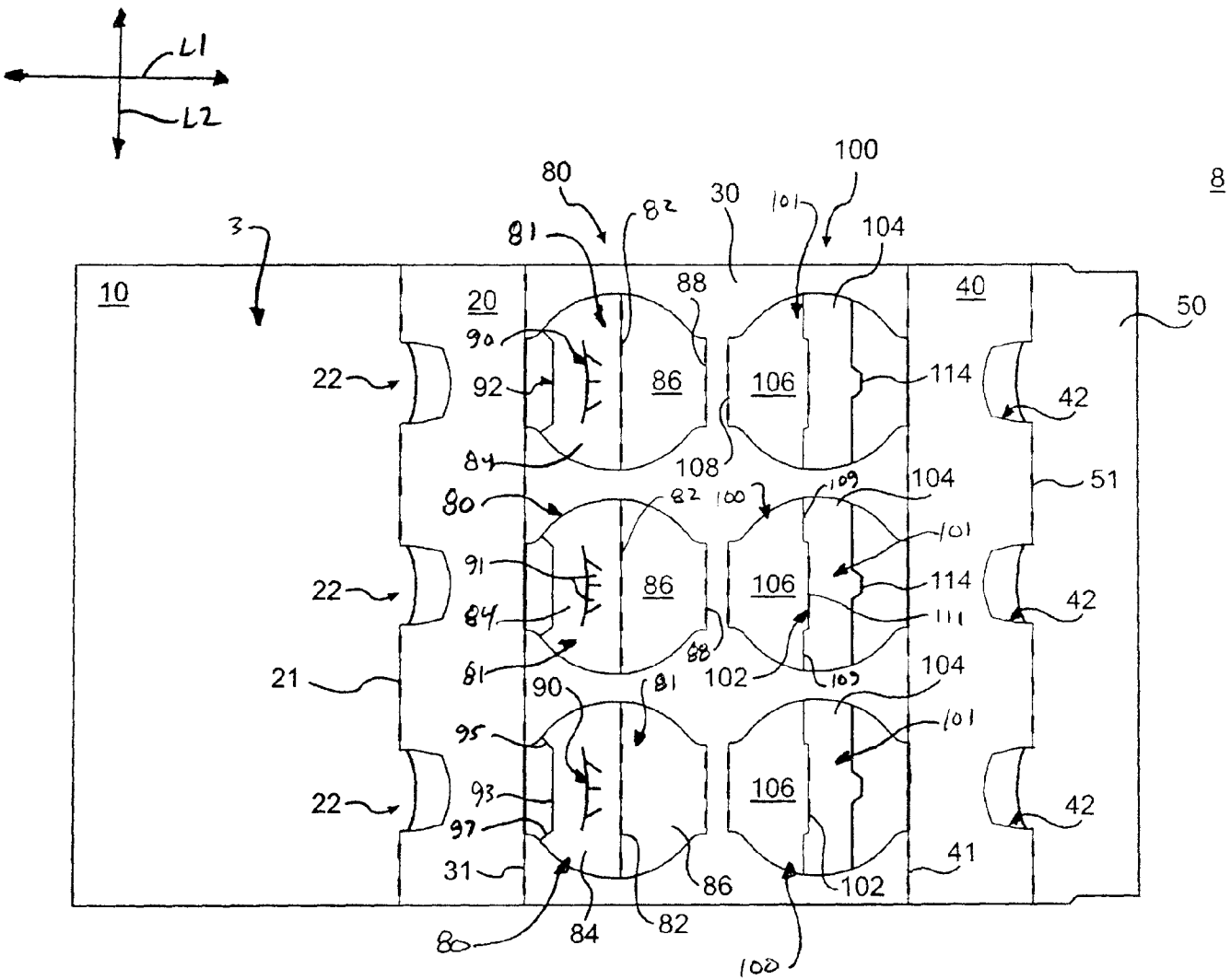
FIG. 1 is a plan view of a blank used to form a package according to a first embodiment of the invention.

FIG. 1 is a plan view of a side 3 of a blank 8 used to form the package or carrier 140 according to the first embodiment of the invention. The blank 8 has a longitudinal axis L1 and a lateral axis L2. The blank 8 comprises a top panel 10 foldably connected to a first side panel 20 at a first lateral fold line 21, a bottom panel 30 foldably connected to the first side panel 20 at a second lateral fold line 31, and a second side panel 40 foldably connected to the bottom panel 30 at a third lateral fold line 41. An adhesive panel 50 may be foldably connected to the second side panel 40 at a fourth lateral fold line 51.

One or more cuts may be included in each of the transverse fold lines 21, 31, 41, 51. In the blank embodiment illustrated in FIG. 1, the transverse fold lines 21, 31, 41, 51 are cut/crease lines in which the cuts facilitate folding of the blank 8 at the fold lines. Any number of cuts may be formed in any of the fold lines, and the number and length of the cuts may be selected according to, for example, the gauge and/or the stiffness of the material used to form the blank 8. The fold lines 21, 31, 41, and 51 may be formed by other methods (e.g., crease lines without cuts) without departing from the invention.

The bottom panel 30 includes a plurality of first and second top-receiving patterns 80, 100, respectively. Each top-receiving pattern 80, 100 is shaped and sized to receive an upper flange portion F of a container C (FIG. 3) that is to be at least partially accommodated within the package 140. Each first top-receiving pattern 80 defines a first brace panel 81 foldably attached to the bottom panel 30. Each first brace panel 81 includes an upper brace section 84 and a first lower brace section 86. Each second top-receiving pattern 100 defines a second brace panel 101 foldably attached to the bottom panel 30. Each second brace panel includes a second upper brace section 104 and a second lower brace section 106. The brace sections 84, 86, 104, 106 interconnect in the erected package 140 to form braces 130 (FIGS. 2-7) for contacting and supporting upper flange portions F of adjacent container C.

Referring to FIG. 1, each first upper brace section 84 is foldably connected to a first lower brace section 86 at a lateral fold line 82, and each first lower brace section 86 is foldably connected to the bottom panel 30 at a lateral fold line 88. Each first upper brace section 84 includes a brace aperture 90. In the illustrated embodiment, the brace aperture 90 is formed by a pattern of slits (e.g., three slits extending from the convex side of an arcuate slit) that define two foldable panels 91 (e.g., flap-like tabs) that are moveable out of the plane of the upper brace section 84 of the blank 8 to open the aperture. Relief sections 92 can be formed at the ends of the first upper brace sections 84. In the illustrated embodiment, the relief sections 92 comprise a lateral edge 93 of the brace section and a first and a second oblique edge 95, 97 at respective ends of the lateral edge, and each relief section is adjacent a hole in the blank 8 while the blank is flat.

Each second upper brace section 104 is foldably attached to a second lower brace section 106 at a lateral fold line 102, and each second lower brace section 106 is foldably connected to the bottom panel 30 at a fold line 108. In the illustrated embodiment, the lateral fold line 102 comprises a lateral cut 109 at each end of the lateral fold line 102 and a middle portion 111 between the lateral cuts that comprises a fold line longitudinally offset form the lateral cuts. The lateral fold line 102 may be otherwise shaped and arranged without departing from the invention. Each second upper brace section 104 includes a brace projection 114 that projects into a hole in the blank 8 while the blank is flat. Each of the brace projections 114 are sized to be received in the correspondingly opposed brace aperture 90 and to facilitate movement of the foldable panels to open the brace aperture.

First upper brace sections 84, first lower brace sections 86, second upper brace sections 104, and second lower brace sections 106 of opposed top receiving patterns 80, 100 are formed into respective braces 130 (FIGS. 2-7) between the receiving patterns. When braces 130 are formed, first container apertures 85 are formed at least in part in the space vacated by the upwardly folded first upper brace section 84 and first lower brace sections 86, and second container apertures 105 are formed at least in part in the space vacated by the upwardly folded second upper brace sections 104 and second lower brace sections 106.

Figure 2:
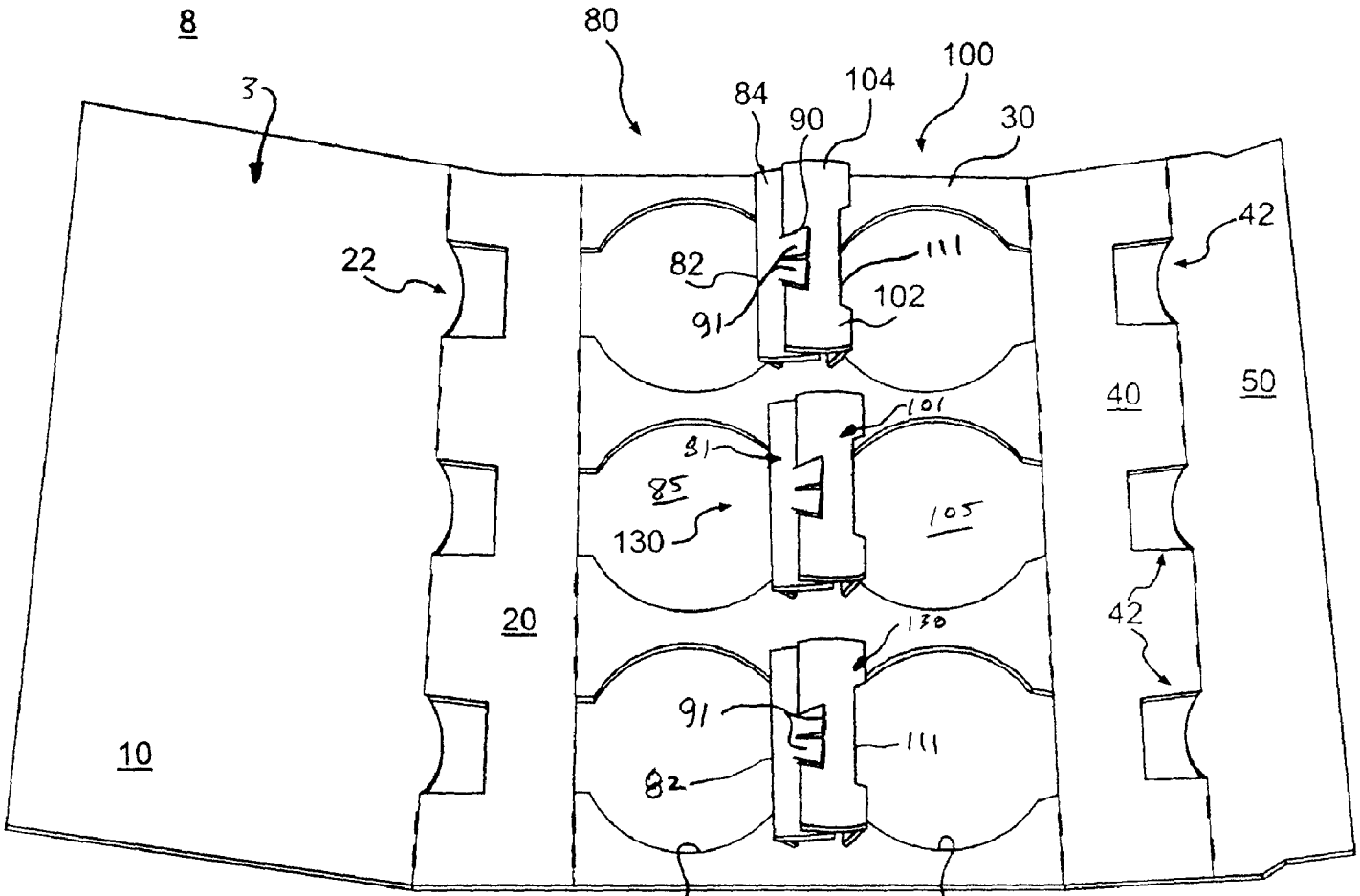
FIG. 2 is a perspective view of the blank partially formed into a package of the first embodiment.
Figure 3:
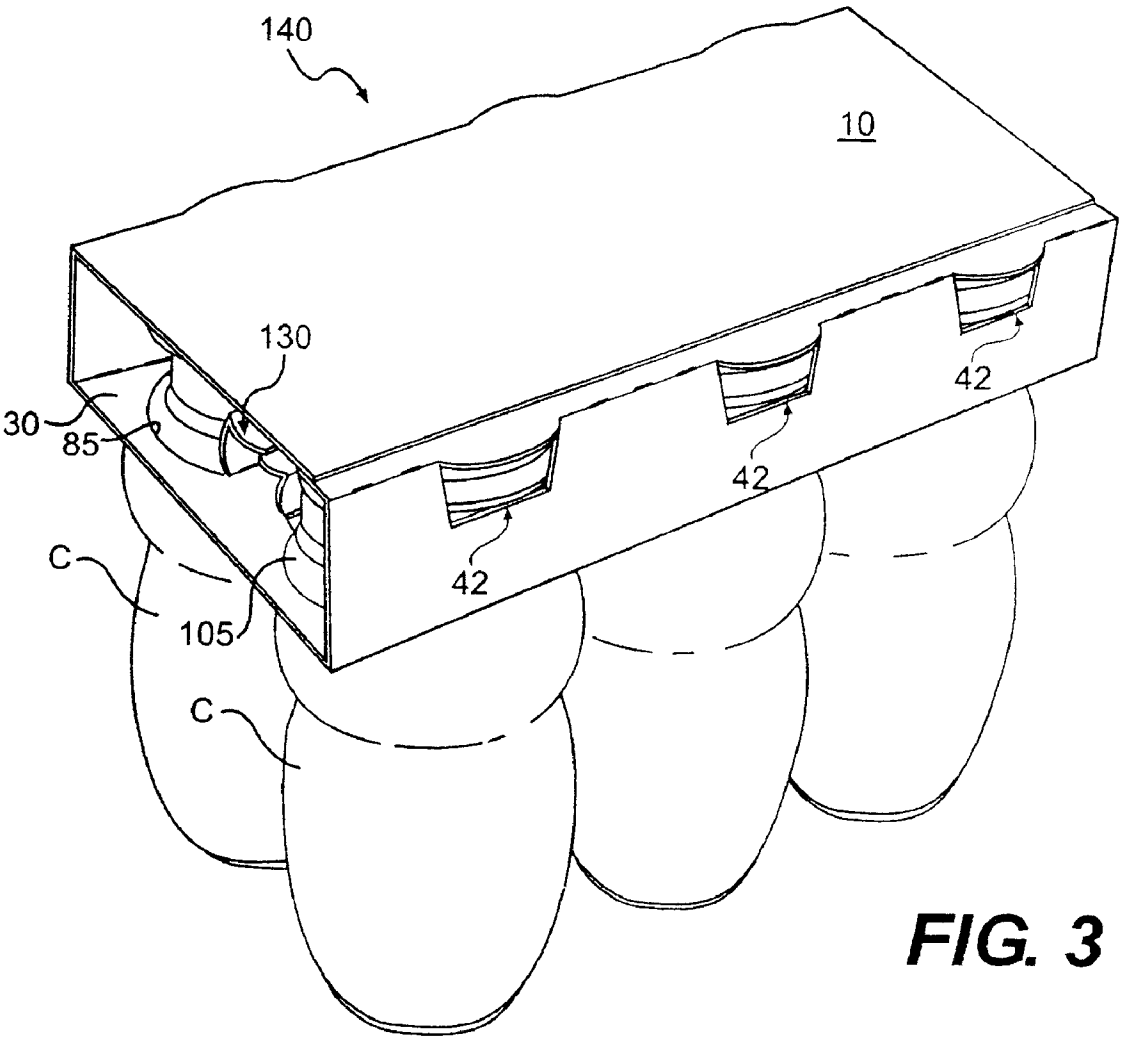
FIG. 3 is a perspective of the package of the first embodiment with containers held therein.
Figure 4:
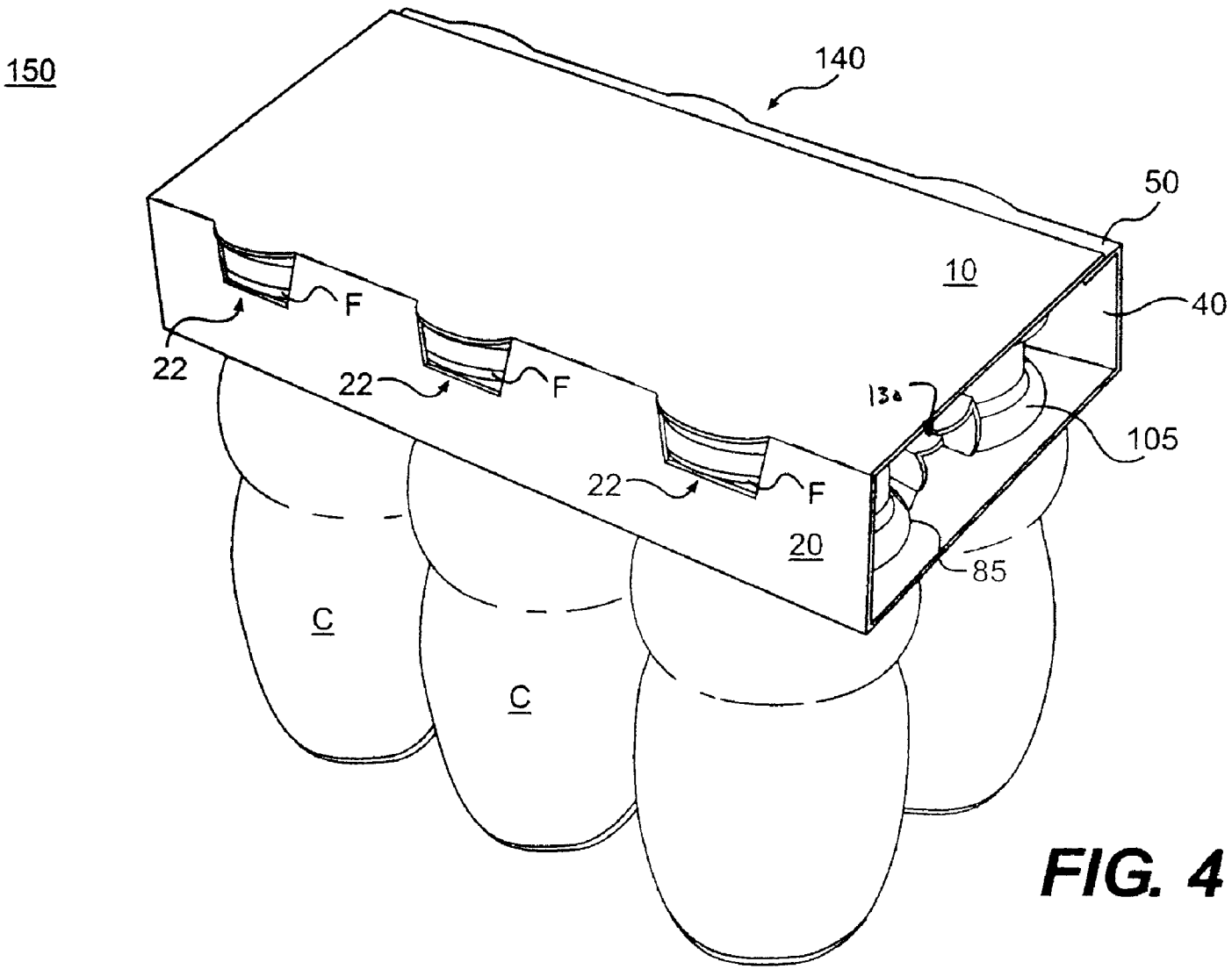
FIG. 4 is a perspective similar to FIG. 3 but showing an opposite side of the package.

The first side panel 20 typically includes side apertures 22 adapted to respectively receive an upper flange portions F of containers C disposed within the first container apertures 85 (illustrated in FIG. 2). The second side panel 40 typically includes second side apertures 42 adapted to receive upper flange portions F of containers C received within the second container apertures 105 (illustrated in FIG. 2).

Figure 5:
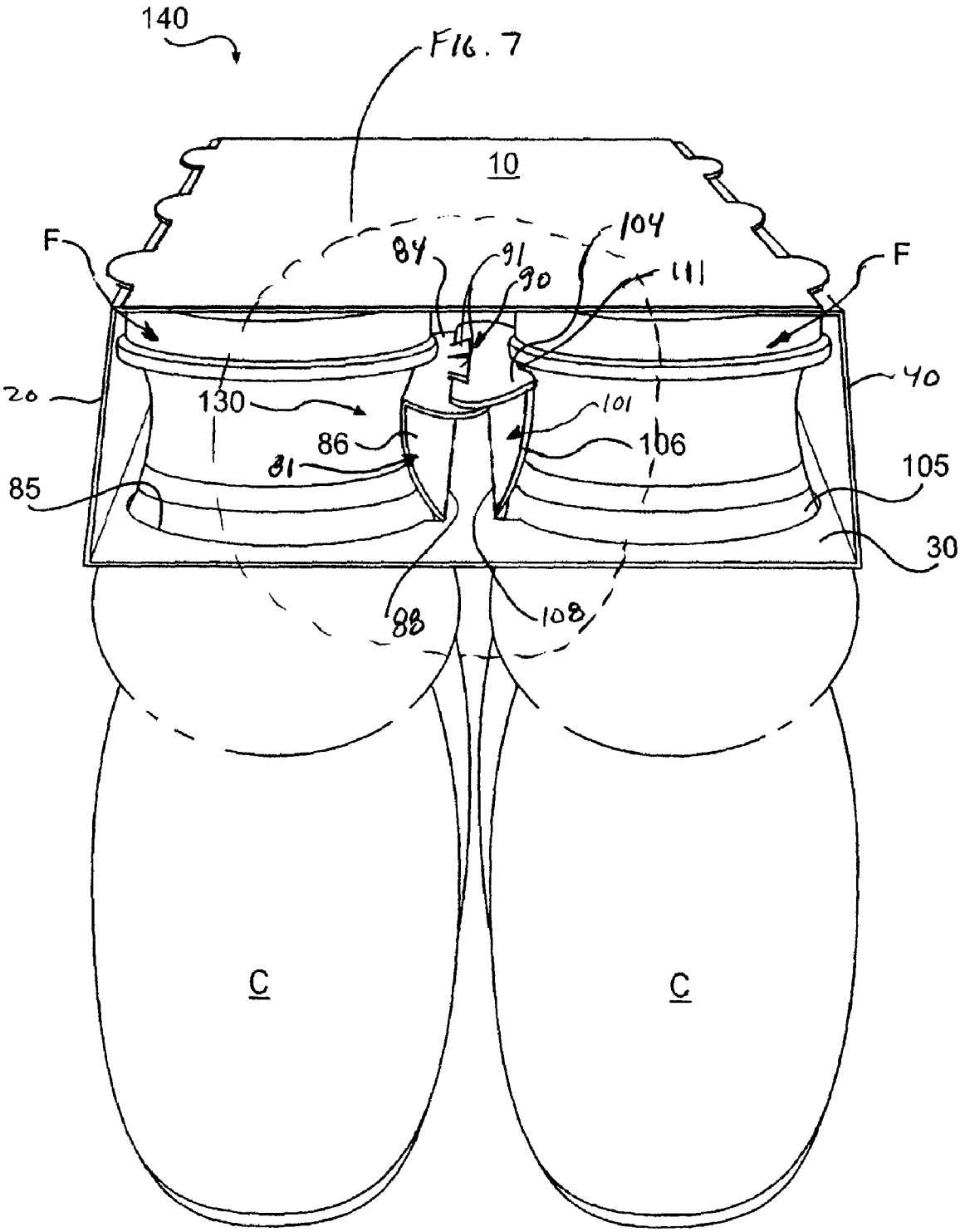
FIG. 5 is an end view of the package of the first embodiment.
Figure 6:
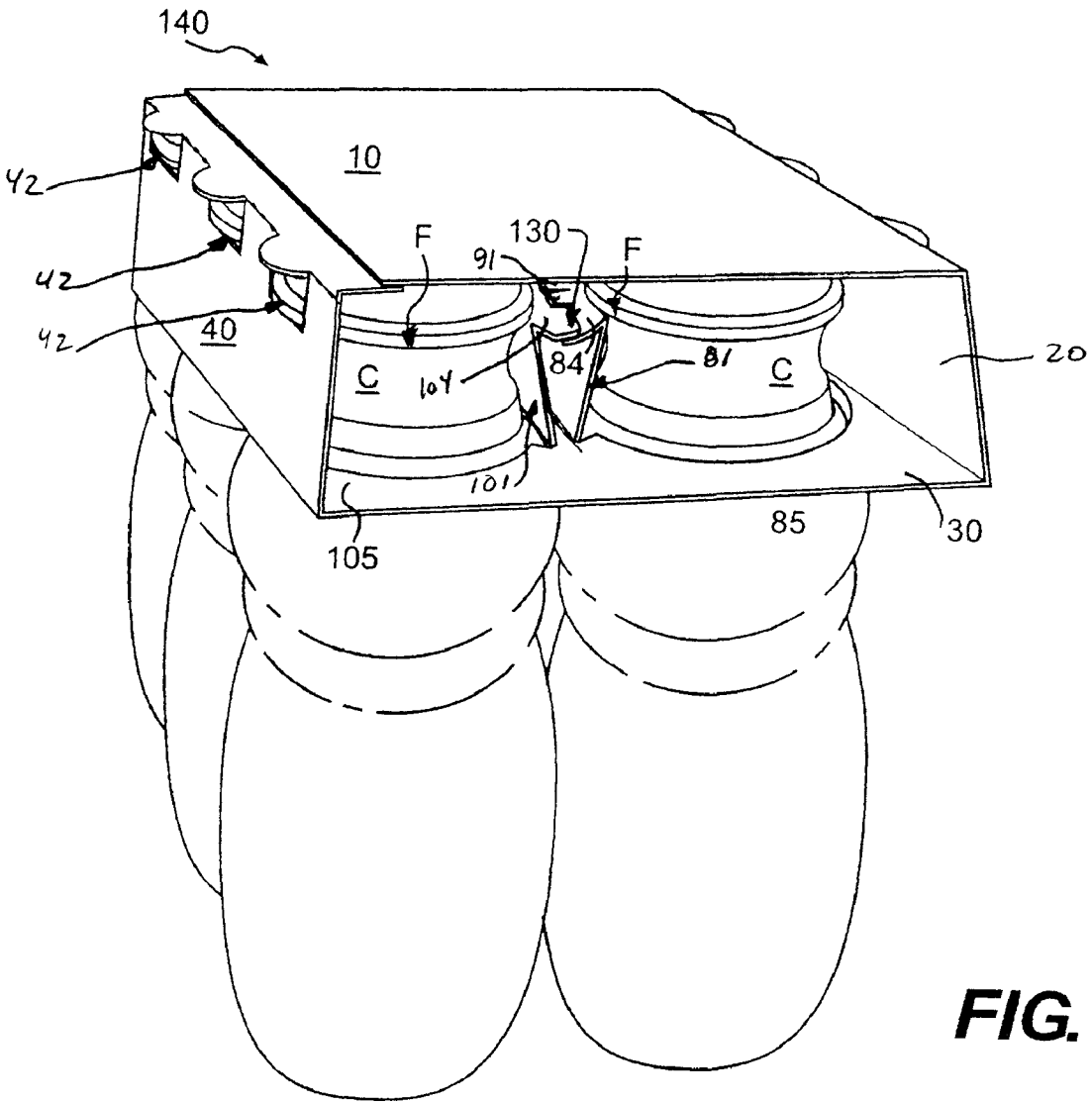
FIG. 6 is an end view of the package of the first embodiment from the opposite end as FIG. 5.

FIG. 2 illustrates a partially assembled package 140 and shows the interlocking engagement of the first upper brace sections 84 and the second upper brace sections 104 to form the braces 130 of the erected package. Referring also to FIG. 1, an exemplary method of erecting the braces 130 is described in the following. The first lower brace sections 86 are folded with respect to the bottom panel 30 about the fold lines 88, and the first upper brace sections 84 are folded with respect to the lower brace sections 86 about the fold lines 82. The second lower brace sections 106 are folded with respect to the bottom panel 30 about the fold lines 108, and the second upper brace sections 104 are folded with respect to the second lower brace sections 106 about the fold lines 102. Each brace projection 114 in a second upper brace section 104 is received in a corresponding brace aperture 90 in a first upper brace section 84 to form a secure engagement between the first brace panel 81 and the second brace panel 101. As shown in FIG. 5, the second upper brace section 104 is partially overlapped with the foldable panels 91 which are upwardly folded from the remaining portion of the first upper brace section 84 to form the aperture 90. The upper brace section 104 partially overlaps the remaining portion of the first upper brace section 84. In the illustrated embodiment, the opposed brace sections 84, 86 and 104, 106 engage to form three braces 130. However, more or less than three braces may be included to accommodate additional or fewer containers without departing from the invention. Also, the orientation of the fold line 102, having a center portion 111 longitudinally spaced from end cuts 109, forms a recessed lateral edge of the upper brace section 104 in the assembled braces 130 corresponding with the length of the center portion 111. The recessed edge 111 forms a container-receiving recess and contacts the upper flange portion F of one of the adjacent containers.

FIGS. 3-7 are various views of the erected package 140 holding containers C at least partially received therein. In the exemplary erected package 140, the adhesive panel 50 may be attached to the top panel 10 by glue or other adhesive, for example. The first and second side panels 20, 40 may extend generally upwardly from the bottom panel 30 toward the top panel 10. The flanges F of the containers C are engaged with the first and second brace apertures 22, 42 in the first and second side panels 20, 40, respectively. The blank 8 may be wrapped relatively tightly around the containers C in order to minimize movement of the containers C within the package 140.

Figure 7:
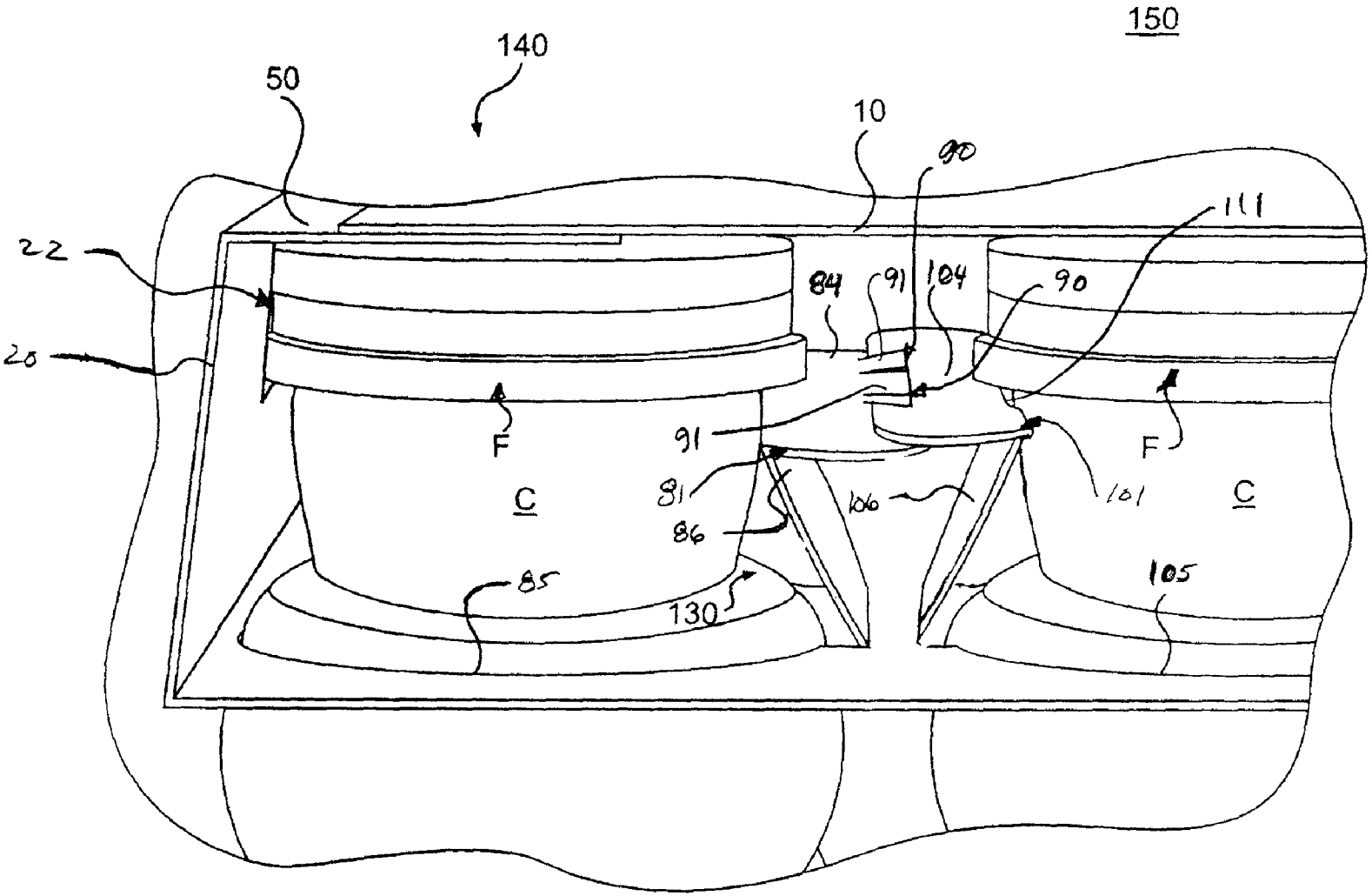
FIG. 7 in an enlarged portion of FIG. 6.

As shown in FIG. 7, the braces 130 engage the flanges F of the containers C accommodated in the package 140. The containers C extend through the container apertures 85, 105 in the bottom panel 30 so that the upper flange portions F of the containers are supported in part by the braces 130. As discussed above with respect to FIG. 2, each brace projection 114 in a second upper brace section 104 is received in a corresponding opposed brace aperture 90 in a first upper brace section 84 to form a brace 130. When the brace projection 114 is received in a corresponding brace aperture 90 foldable panels 91 are upwardly folded to receive the projection and then apply a downward force against the projection to secure the first brace panel 81 and second brace panel 101 in interlocking engagement. The support of the braces 130 under the flange sections F, along with the support of the first and second brace apertures 22, 42 in the first and second side panels 20, 40, securely retain the containers C within the package 140. Contact of the containers C with the bottom panel 30 at the apertures 85, 105, and contact with the top panel 10 also secure the containers C in the package 140.

Figure 8:
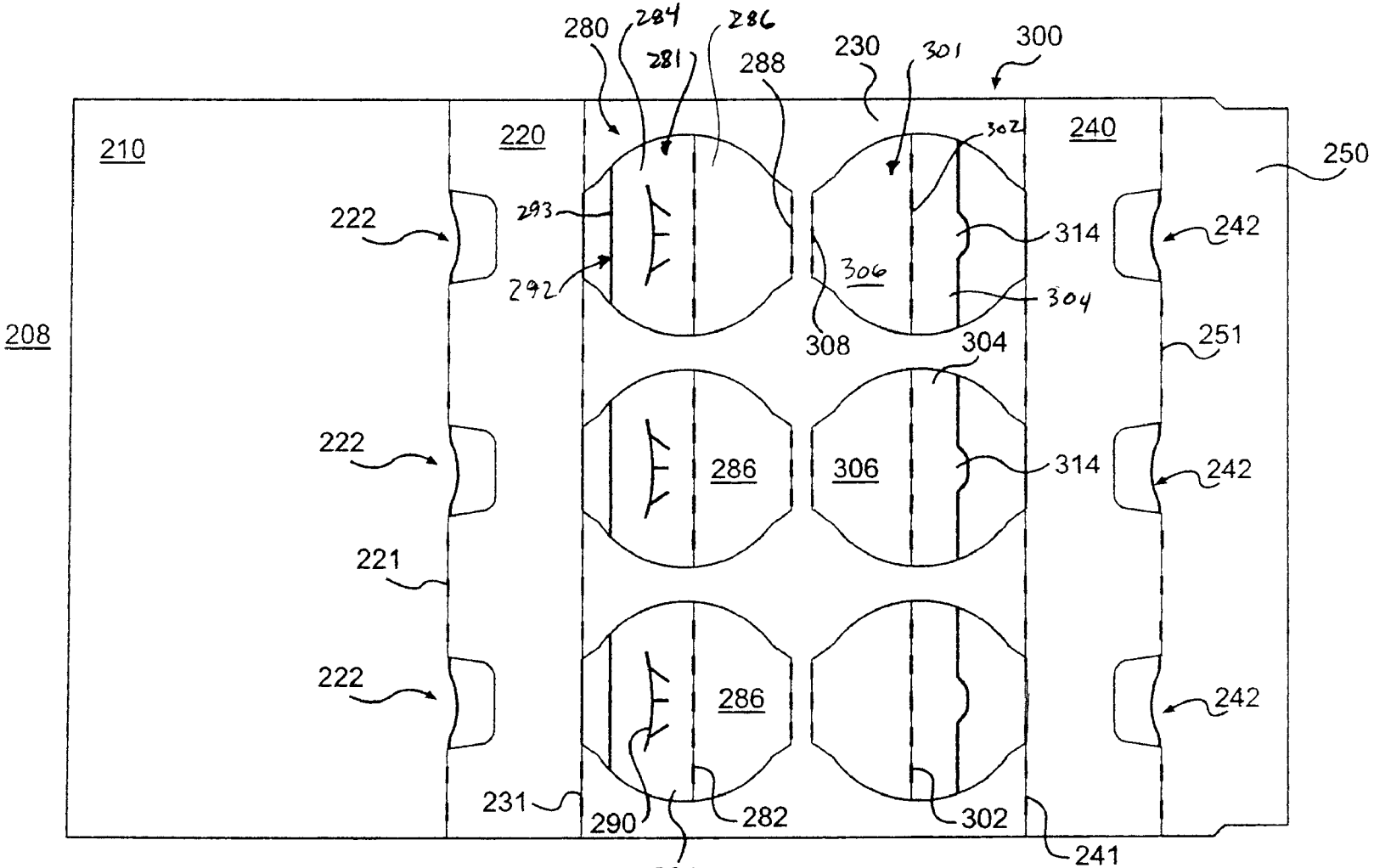
FIG. 8 a plan view of a blank used to form a package according to a second embodiment of the invention.

FIG. 8 is a plan view of the exterior 203 or printed side of a blank 208 of a second embodiment, similar to the blank 8 of the first embodiment. The blank 208 is used to form a package or carrier 340 (FIG. 10) according to the second embodiment of the invention having braces 330. Like reference numbers designating similar components of the blank 208 from the blank 8 of the first embodiment are designated with the prefix "2--" or "3--".

Figure 9:
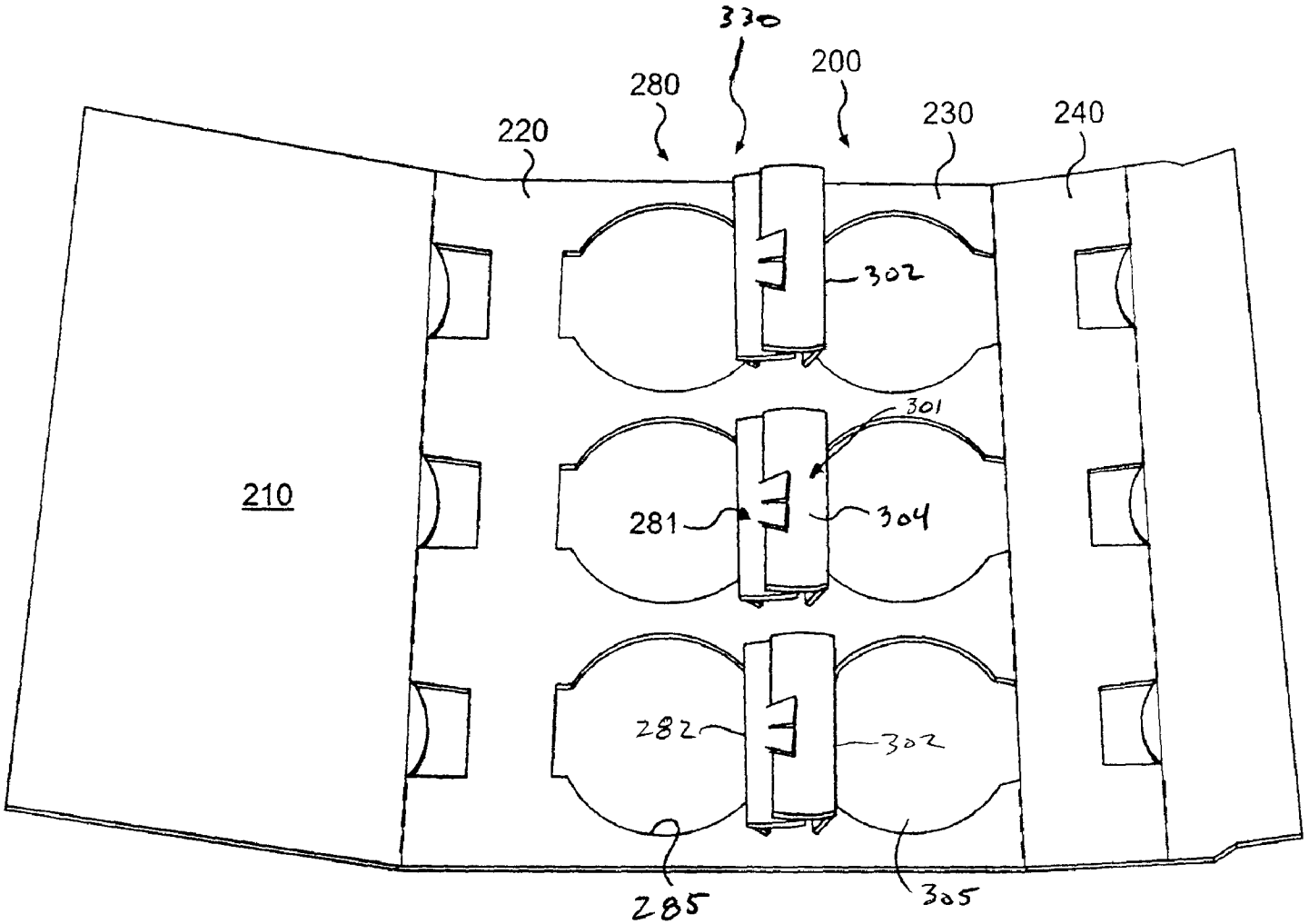
FIG. 9 is a perspective view of the blank of FIG. 8 partially assembled into a package of the second embodiment.
Figure 10:
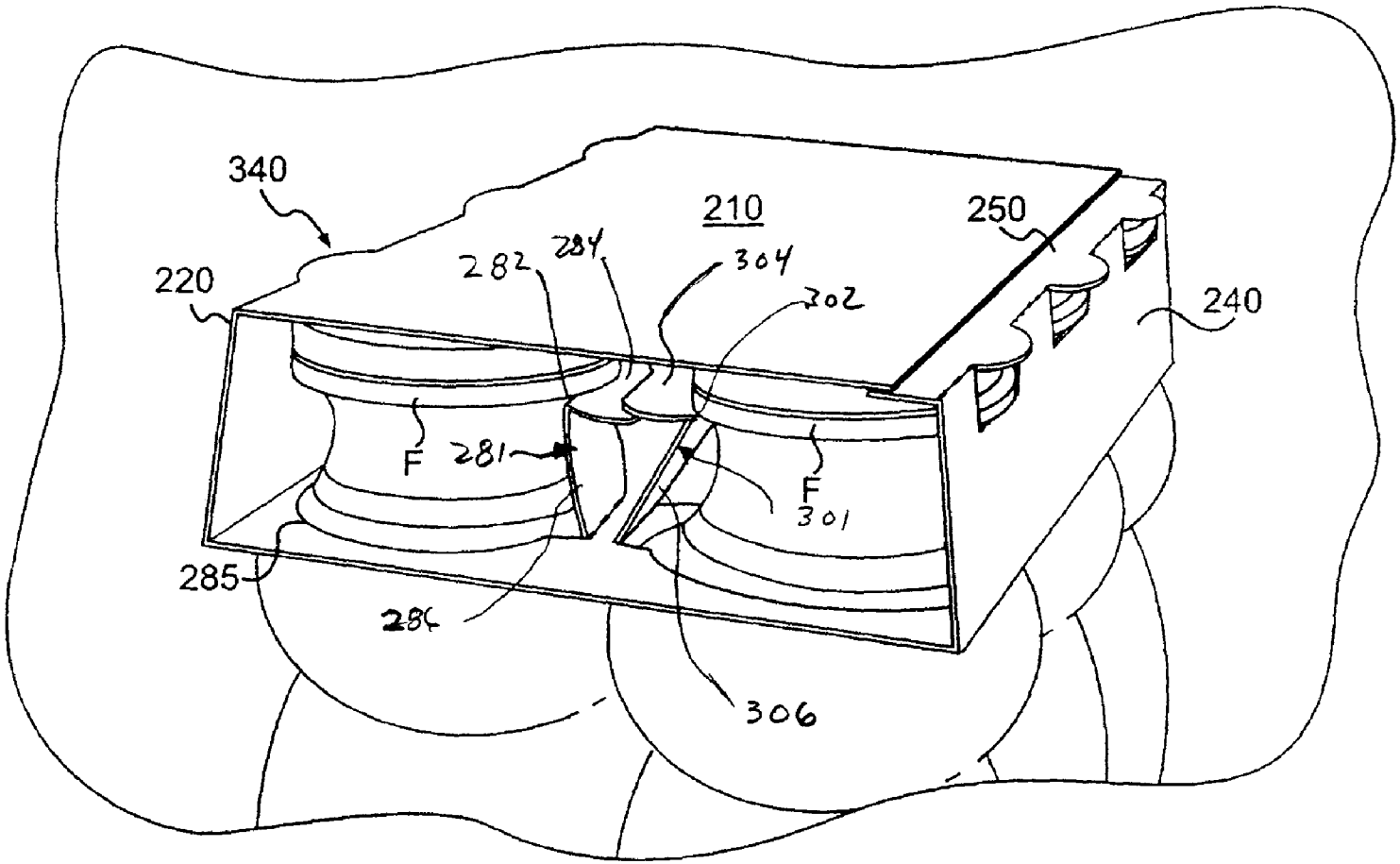
FIG. 10 is an enlarged view of the package of the second embodiment.

The bottom panel 230 of the blank 208 includes a plurality of first and second top-receiving patterns 280, 300, similar to the top receiving patterns 80, 100 of the first embodiment. In the second embodiment, the top receiving patterns 280 each include a relief section 292 formed by a straight lateral edge 293 of the first upper brace portion 284 of the first brace panel 281 of the first upper brace portion 284. The lateral edge 293 extends between the opposed curved cuts separating the first upper brace section 284 from the bottom panel 230. Also, the second brace panels 301 each includes a lateral fold line 302 connecting second upper brace section 304 with the second lower brace section 306. In the embodiment of FIGS. 8-10, the lateral fold line 302 extends between opposed curved cuts defining the second brace panel 301 in the bottom panel 230. As shown in FIGS. 9 and 10, the lateral fold line 302 and the lateral fold line 282 form opposed edge surfaces of the braces 330 that contact the flange portion F of the containers.

Figure 11:
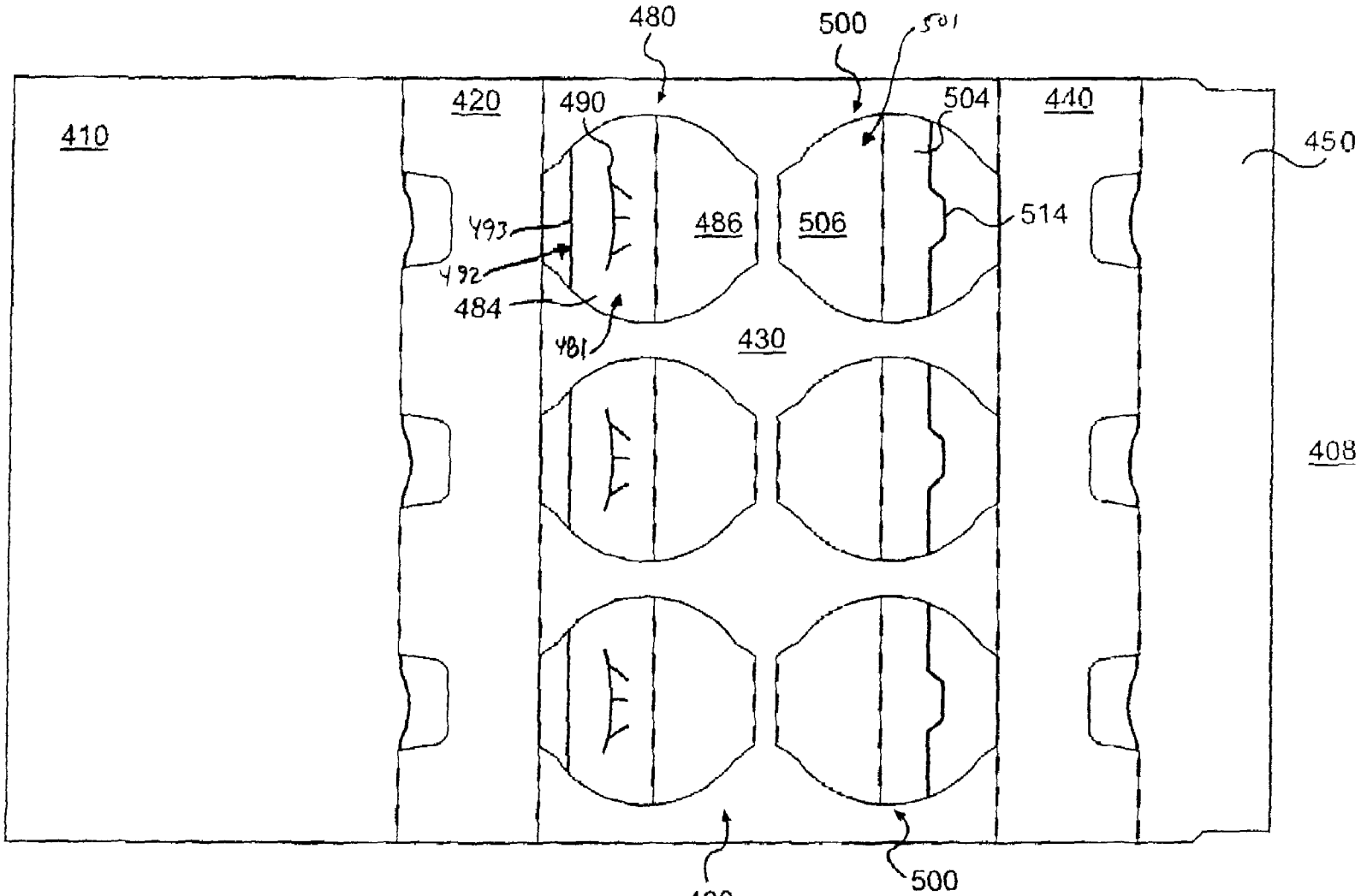
FIG. 11 is a plan view of an exterior side of a blank used to form a package according to a third embodiment of the invention.

FIG. 11 is a plan view of a blank 408 used to form a package 540 according to a third embodiment of the invention. The blank 408 is similar to the package blank 208 illustrated in FIG. 8-10 and discussed above, and like or similar reference numerals may indicate like or similar elements in the figures. The blank 408 includes brace apertures 490 formed in first upper brace sections 484 of first brace panel 481, and brace projections 514 formed in second upper brace sections 504 of second brace panel 501. The brace projections 514 are slightly larger in the lateral direction L2 of the blank 408 than the brace projections 214 illustrated in FIG. 8.

Figure 12:
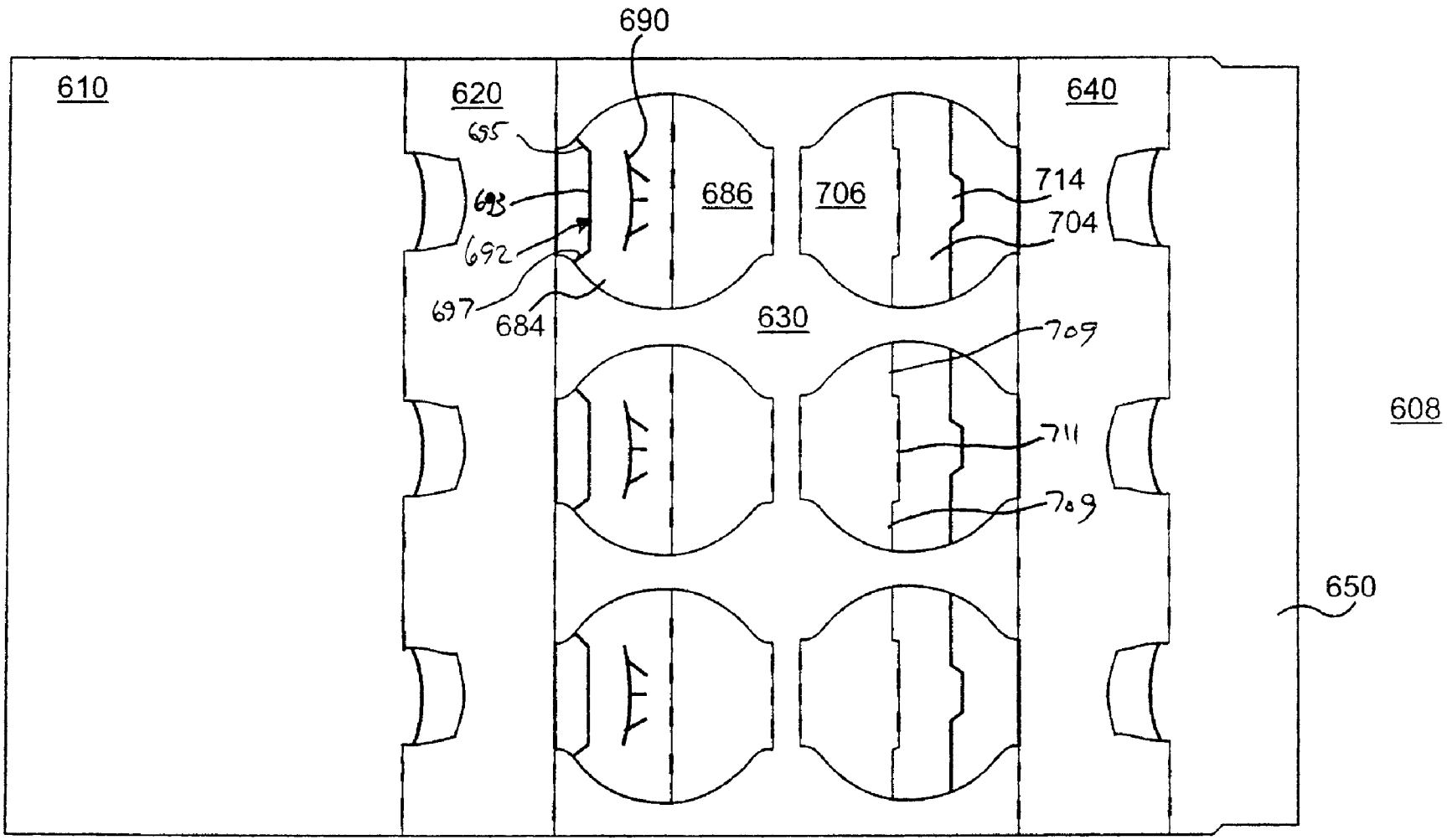
FIG. 12 a plan view of a blank used to form a package according to a fourth embodiment of the invention.

FIG. 12 is a plan view of a blank 608 used to form a package according to a fourth embodiment of the invention. The blank 608 is similar to the blank 8 illustrated in FIG. 1, and like or similar reference numerals may indicate like or similar elements in the figures. The blank 608 includes brace apertures 690 formed in first upper brace sections 684, and brace projections 714 formed in second upper brace sections 604. The brace projections 714 are slightly larger in the lateral direction L2 of the blank than the brace projections 114 illustrated in FIG. 1.

Figure 13:
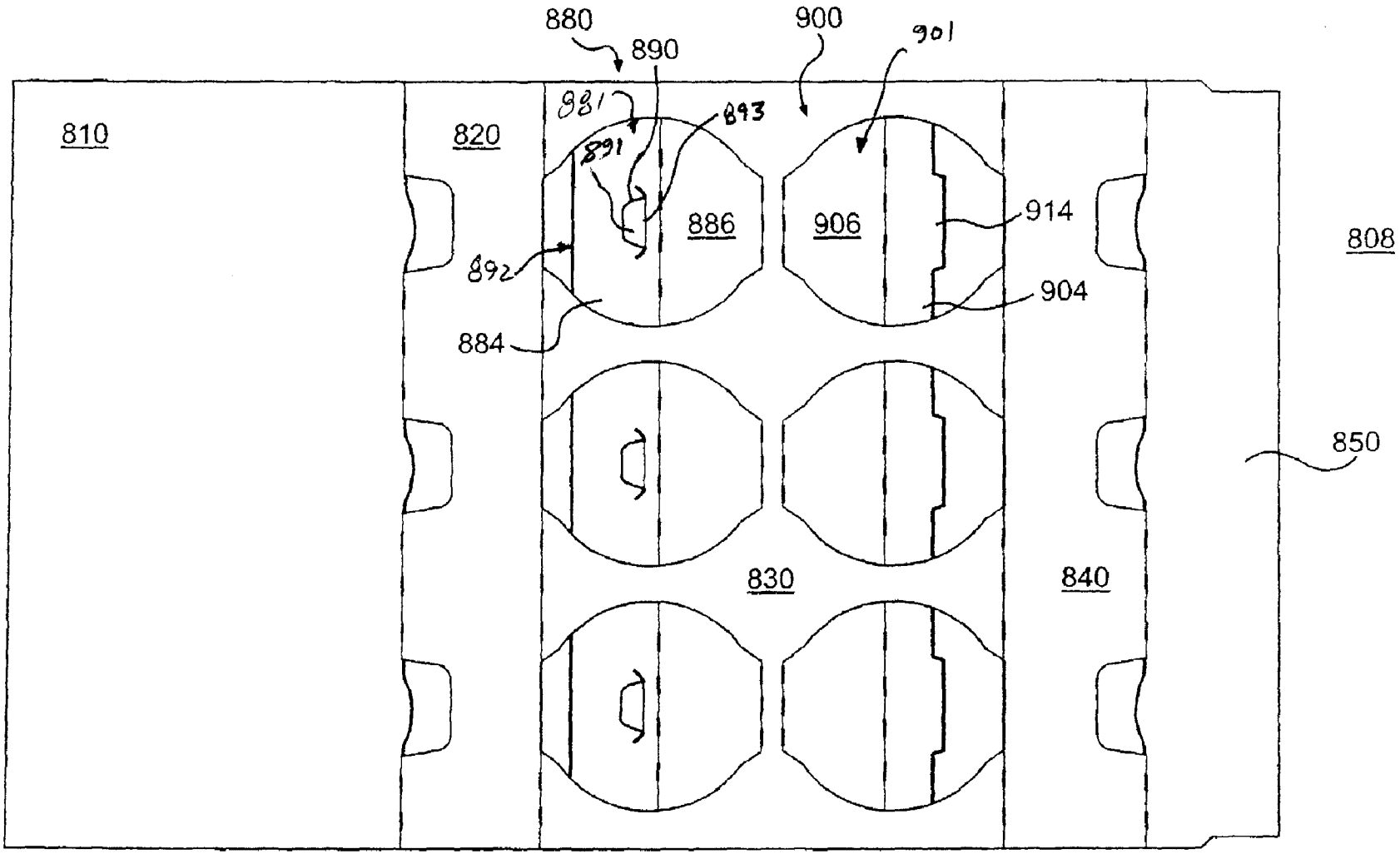
FIG. 13 is a plan view of a blank used to form a package according to a fifth embodiment of the invention.

FIG. 13 is a plan view of a blank 808 used to form a package 940 (FIG. 14) according to a fifth embodiment of the invention. The blank 808 is similar to the blanks 8, 208, 408, 608, and like or similar reference numerals may indicate like or similar elements in the figures. The bottom panel 830 includes a plurality of first and second top-receiving patterns 880, 900, respectively. Each first top-receiving pattern 880 defines a first brace panel 881 having a first upper brace section 884 and a first lower brace section 886. Each second top-receiving pattern 900 defines a second brace panel 901 having a second upper brace section 904 and a second lower brace section 906. The brace sections 886, 886, 904, 906 of the first and second brace panels 881, 901 interconnect in the erected package 940 to form braces 930 (illustrated in FIGS. 35-37). Each first upper brace section 884 includes a brace aperture 890 sized to receive a brace projection 914 located on a second upper brace section 904. Each aperture 890 includes a brace tab 891 foldably attached to the upper brace section 884 at a lateral fold line 893. When a brace projection 914 at least partially enters the brace aperture 890 (i.e., is received beneath the tab 891), a bottom surface of a brace tab 891 on the first upper brace section 884 is pushed upwardly by the projection 914.

Figure 14:
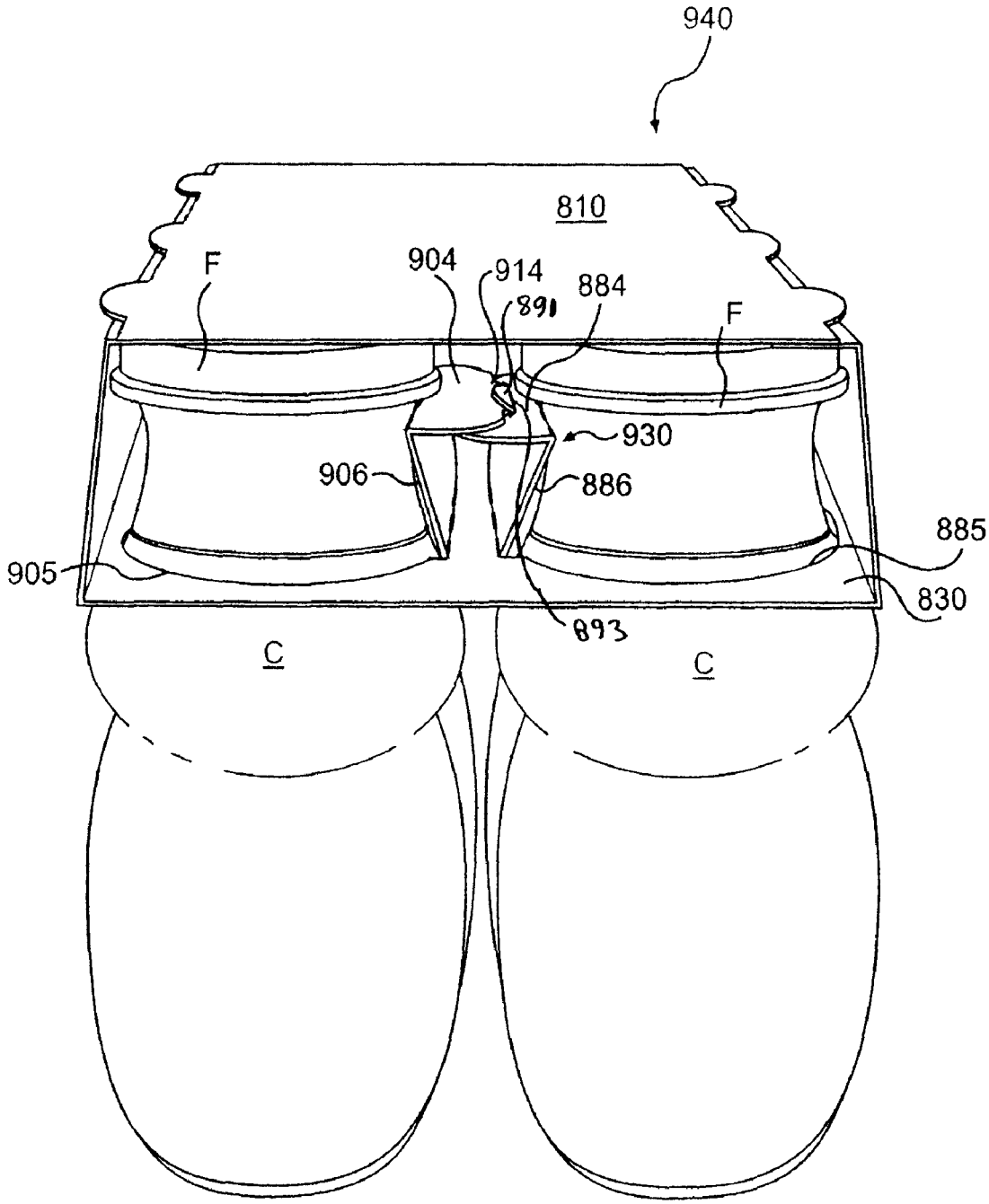
FIG. 14 is an end view of the package of the fifth embodiment.

Referring to FIG. 14, braces 930 engage undersides of the flanges F of the containers C. Each brace projection 914 in a second upper brace section 904 is received in a corresponding opposed brace aperture 890 in a first upper brace section 884 to form a brace 930. The brace projections 914 respectively pressed into the brace apertures 890 force the brace tabs 891 on the first upper brace sections 884 upwardly. The tab 891 applies a downward force against the portion of the brace projection 914 received in the aperture 890 so as to secure the first brace panel 881 and second brace panel 901 in interlocking engagement.

Figure 15:
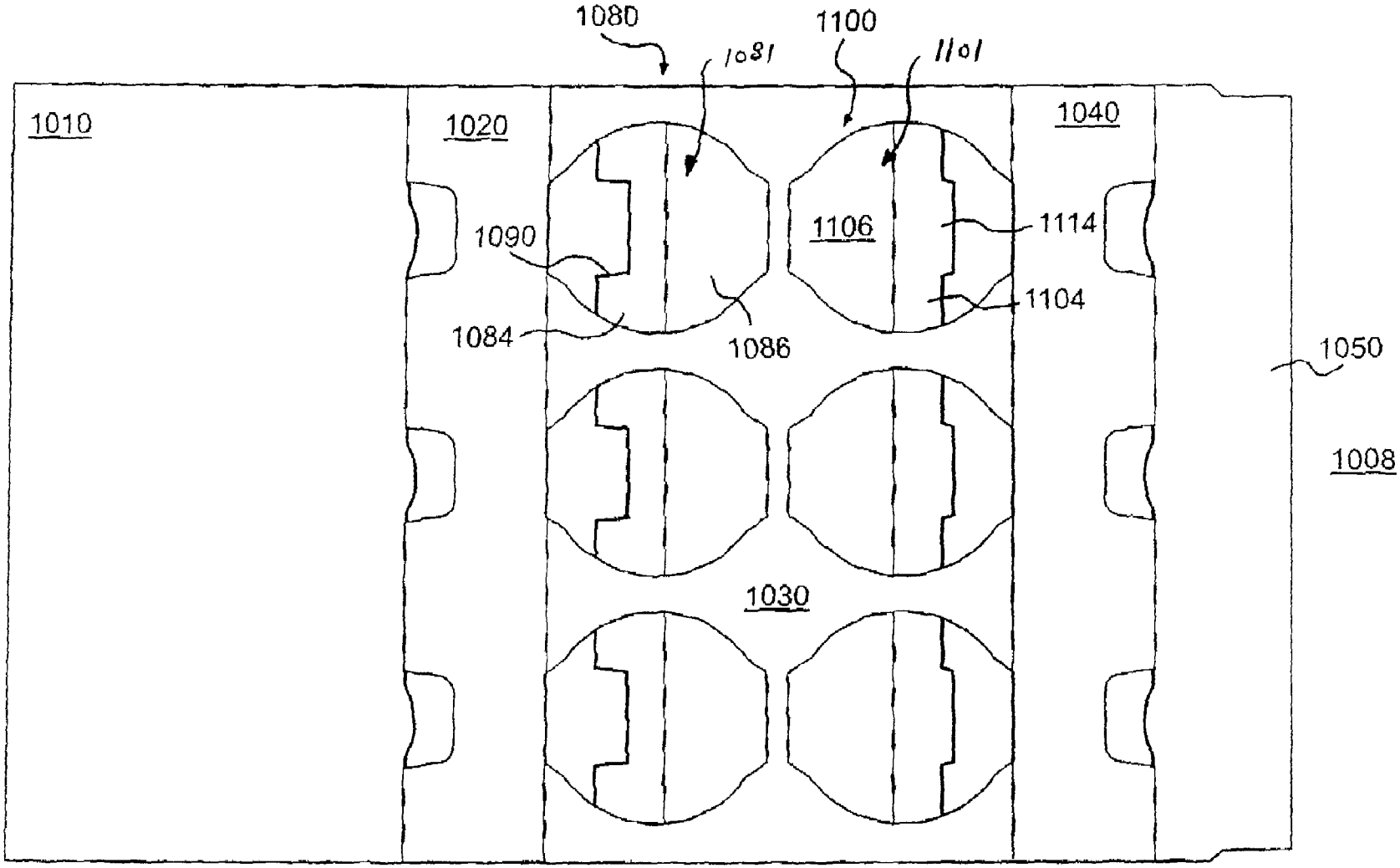
FIG. 15 is a plan view of a blank used to form a package according to a sixth embodiment of the invention.

FIG. 15 is a plan view of a blank 1008 used to form a package 1140 according to a sixth embodiment of the invention. The blank 1008 is similar to the blank 808 of the fifth embodiment, and like or similar reference numerals may indicate like or similar elements in the figures.

Figure 16:
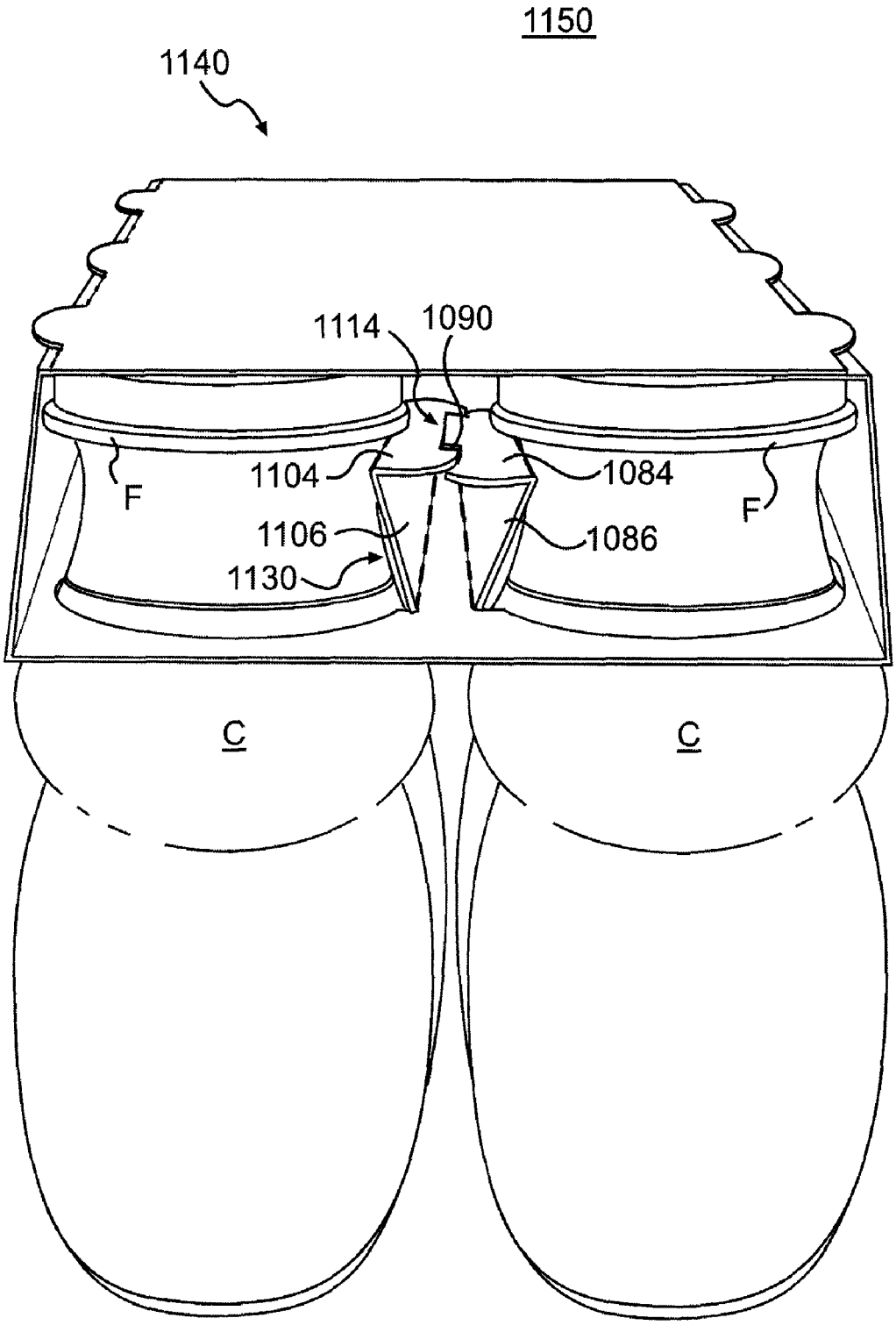
FIG. 16 is an end view of the package of the sixth embodiment.

The bottom panel 1030 includes a plurality of first and second top-receiving patterns 1080, 1100, respectively. Each first top-receiving pattern 1080 defines a first brace panel 1081 having a first upper brace section 1084 and a first lower brace section 1086. Each second top-receiving pattern 1100 defines a second brace panel 1101 having a second upper brace section 1104 and a second lower brace section 1106. The brace sections 1086, 1086, 1104, 1106 interconnect in the erected package 1140 to form braces 1130 (FIG. 16). Each first upper brace section 1084 includes a brace relief section or aperture 1090 sized to receive a brace projection 1114 located on a second upper brace section 1104.

Referring to FIG. 16, braces 1130 engage the undersides of flanges F of the containers C. Each brace projection 1114 in a second upper brace section 1104 is received in a corresponding opposed brace relief section or aperture 1090 in a first upper brace section 1084 to form a brace 1130.

In the above-discussed embodiments, the term "top-receiving" pattern or aperture should be broadly construed, for example, to mean that an upper portion of a container may pass through an aperture designated as "top-receiving" when assembling a package.

The exemplary package embodiments discussed above accommodate six containers C arranged in two columns and three rows, but the present invention is not limited to these numbers. As one example, additional rows of containers may be added by increasing the width of the blanks (e.g., in the lateral direction L2 in FIG. 1) and forming additional opposed patterns and brace apertures.

In the above embodiments, the packages are shown as accommodating containers C having a generally round upper rims or caps. Other types of containers, however, can be accommodated within a package according to the principles of the present invention.

The exemplary package embodiments discussed above include upper brace sections that are secured together by engaging brace apertures with brace projections. An alternative embodiment may include opposed upper brace sections that are secured together by an adhesive such as glue. In such an alternative embodiment, brace apertures and brace projections may be omitted.

In general, the blanks may be constructed from paperboard having a caliper of at least about 14, for example, so that it is heavier and more rigid than ordinary paper. The blanks can also be constructed of other materials, such as cardboard, or any other material having properties suitable for enabling the package to function at least generally as described above.

The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A package and a plurality of containers, the package comprising:

panels that extend at least partially around an interior of the package, the panels comprise a top panel, a bottom panel, a first side panel and a second side panel, wherein the bottom panel defines the bottom of the interior of the package;

at least one feature in the bottom panel that receives and holds top portions of the containers, the at least one feature comprising at least two apertures for receiving the top portions of the containers and a brace disposed between the apertures in the interior of the package to engage the containers and at least partially restrain movement of the containers in the package, the brace comprising a first brace panel foldably attached to the bottom panel and a second brace panel foldably attached to the bottom panel, the first and second brace panels being interlockingly engaged to form the brace, the first brace panel comprising a first upper brace section and a brace aperture, and the second brace panel comprising a second upper brace section and a projection, the projection being received in the brace aperture, wherein the brace aperture comprises at least an arcuate first slit and a second slit extending from the first slit, and the brace aperture at least partially defines at least one flap;

wherein a bottom surface of the second upper brace section at least partially overlaps the first upper brace section, and the at least one flap of the first brace panel at least partially overlaps a top surface of the second upper brace section; and wherein each container of the plurality of containers comprises a flange, and each of the first and second brace panels engages an underside of at least one of the flanges; wherein the brace aperture further comprises a third slit and a fourth slit, the second, third, and fourth slits extending from a convex side of the arcuate first slit, wherein the arcuate first slit comprises two ends within the first upper brace section and the second, third, and fourth slits are spaced apart from the two ends of the arcuate first slit, and wherein the at least one flap comprises at least two flaps at least partially defined by the first, second, third, and fourth slits.

2. The package of claim 1 wherein the at least one flap is two flaps, the second slit extends at least partially between the two flaps.

3. The package of claim 1 wherein the first brace panel comprises a first lower brace section foldably attached to the first upper brace section, and the second brace panel comprises a second lower brace section foldably attached to the second upper brace section.

4. The package of claim 3 wherein the second brace panel comprises a fold line foldably connecting the second upper brace section and the second lower brace section and two spaced apart end cuts, each end cut extending from a respective end of the fold line to a respective outer edge of the second brace panel, the two spaced apart end cuts separating portions of the second upper brace section from the second lower brace section, wherein at least a portion of each of the two spaced apart end cuts is generally parallel to the fold line.

5. The package of claim 4 wherein the fold line is offset from the end cuts to form a container-receiving recess in the second upper brace section.

6. The package of claim 1 wherein the first and second side panels have apertures for receiving at least a portion of the containers.

7. A blank for forming a package for holding a plurality of containers, the blank comprising:

panels comprising a top panel, a bottom panel, a first side panel and a second side panel, the panels are for forming an interior of the package formed from the blank, wherein the bottom panel defines the bottom of the interior of the package formed from the blank;

at least two apertures in the bottom panel, a first brace panel foldably attached to the bottom panel and a second brace panel foldably attached to the bottom panel, the first and second brace panels being adapted for interlocking engagement with respect to one another within the interior of the package formed by the blank, and the first and second brace panels being respectively positioned in the apertures, the first brace panel comprising a first upper brace section and a brace aperture, and the second brace panel comprising a second upper brace section and a projection for being received in the brace aperture, wherein the brace aperture comprises at least an arcuate first slit and a second slit extending from the first slit, and the brace aperture at least partially defines at least one flap;

wherein a bottom surface of the second upper brace section is for at least partially overlapping the first upper brace section, and the at least one flap of the first brace panel is for at least partially overlapping a top surface of the second upper brace section in the package formed from the blank; and wherein each container of the plurality of containers comprises a flange, and each of the first and second brace panels is for engaging an underside of at least one of the flanges; wherein the brace aperture further comprises a third slit and a fourth slit, the second, third, and fourth slits extending from a convex side of the arcuate first slit, wherein the arcuate first slit comprises two ends within the first upper brace section and the second, third, and fourth slits are spaced apart from the two ends of the arcuate first slit, and wherein the at least one flap comprises at least two flaps at least partially defined by the first, second, third, and fourth slits.

8. The blank of claim 7 wherein the at least one flap is two flaps, the second slit extends at least partially between the two flaps.

9. The blank of claim 7 wherein the first brace panel comprises a first lower brace section foldably attached to the first upper brace section and the second brace panel comprises a second lower brace section foldably attached to the second upper brace section.

10. The blank of claim 9 wherein the second brace panel comprises a fold line foldably connecting the second upper brace section and the second lower brace section and two spaced apart end cuts, each end cut extending from a respective end of the fold line to a respective outer edge of the second brace panel, the two spaced apart end cuts separating portions of the second upper brace section from the second lower brace section wherein at least a portion of each of the two spaced apart end cuts is generally parallel to the fold line.

11. The blank of claim 10 wherein the fold line is offset from the end cuts to form a container-receiving recess in the second upper brace section.

12. The blank of claim 7 wherein the first and second side panels have apertures for receiving at least a portion of the containers.

13. A method of forming a package for containing a plurality of containers, the method comprising:

providing a blank having a bottom panel, a top panel, a first side panel, a second side panel, a first brace panel foldably attached to the bottom panel, and a second brace panel foldably attached to the bottom panel, wherein the first brace panel comprises a first upper brace section and a brace aperture and the second brace panel comprises a second upper brace section and a projection, the brace aperture comprising at least an arcuate first slit and a second slit extending from the first slit, and the brace aperture at least partially defining at least one flap;

forming an interior of the package defined by the top panel, the bottom panel, the first side panel, and the second side panel, wherein the bottom panel defines the bottom of the interior of the package;

forming a brace in the interior of the package by folding the first brace panel and the second brace panel so that the brace panels are in interlocking engagement, wherein the projection is received in the brace aperture so that a bottom surface of the second upper brace section at least partially overlaps the first upper brace section, and the at least one flap of the first brace panel at least partially overlaps a top surface of the second upper brace section; and inserting at least one container into a container-receiving aperture in the bottom panels and holding a top portion of the container in the package, wherein each container of the plurality of containers comprises a flange, and each of the first and second brace panels engages an underside of at least one of the flanges; wherein the brace aperture further comprises a third slit and a fourth slit, the second, third, and fourth slits extending from a convex side of the arcuate first slit, wherein the arcuate first slit comprises two ends within the first upper brace section and the second, third, and fourth slits are spaced apart from the two ends of the arcuate first slit, and wherein the at least one flap comprises at least two flaps at least partially defined by the first, second, third, and fourth slits.

14. The method of claim 13 wherein the at least one flap comprises two flaps at least partially defined by the first slit and the second slit.

15. The package of claim 1, wherein the first brace panel is at least partially defined by an outer edge, and the brace aperture is spaced apart from the outer edge of the first brace panel.

16. The blank of claim 7, wherein the first brace panel is at least partially defined by an outer edge, and the brace aperture is spaced apart from the outer edge of the first brace panel.

17. The method of claim 13, wherein the first brace panel is at least partially defined by an outer edge, and the brace aperture is spaced apart from the outer edge of the first brace panel.

* * * * *